United States Patent [19]

Häfele

[11] 4,172,699

[45] Oct. 30, 1979

[54] CHAMBER-CONTROLLED FUEL INJECTION PUMP FOR INTERNAL COMBUSTION ENGINES

[75] Inventor: Walter Häfele, Fellbach, Fed. Rep. of Germany

[73] Assignee: Robert Bosch GmbH, Stuttgart, Fed. Rep. of Germany

[21] Appl. No.: 906,282

[22] Filed: May 15, 1978

[30] Foreign Application Priority Data

Jul. 2, 1977 [DE] Fed. Rep. of Germany ..... 2730091

[51] Int. Cl.[2] ..... F02M 59/26

[52] U.S. Cl. ..... 417/499; 123/139 AD

[58] Field of Search ..... 417/494, 499; 123/139 AR, 139 AD

[56] References Cited

U.S. PATENT DOCUMENTS

| | | | |
|---|---|---|---|
| 2,384,011 | 9/1945 | Bremser | 417/494 |
| 3,368,491 | 2/1968 | Shook et al. | 417/494 |
| 4,118,156 | 10/1978 | Ivosevic | 417/494 |

*Primary Examiner*—Carlton R. Croyle
*Assistant Examiner*—Leonard E. Smith
*Attorney, Agent, or Firm*—Edwin E. Greigg

[57] ABSTRACT

A fuel injection pump for internal combustion engines, which has improved and simplified means for a throttled preliminary shut-off to prevent cavitation in the injection system and late injections by the fuel injection valves. The pump piston is provided with two recesses that terminate in chamfered control edges and control the end of the delivery cycle and also contains a throttle bore, which has a cross bore, and connects the first recess, which is opened shortly before the other recess, with the pump operating chamber by means of a longitudinal bore in the pump piston. The second recess has an unthrottled connection to the pump operating chamber.

10 Claims, 5 Drawing Figures

CHAMBER-CONTROLLED FUEL INJECTION PUMP FOR INTERNAL COMBUSTION ENGINES

BACKGROUND OF THE INVENTION

The invention relates to a fuel injection pump of the type including a chamfer-edge-controlled fuel pump for internal combustion engines having an axially and rotationally movable pump piston guided in a pump cylinder, which pump piston includes in its outer surface two diametrically opposite control bores and recesses that terminate in chamfered control edges which recesses are in continual communication with the pump operating chamber. Further, these recesses can be connected with a low pressure chamber through two control bores lying opposite each other in the wall of the pump cylinder to terminate the effective delivery stroke, and of these recesses the first can be opened shortly before the second by its associated control bore and thus serve as an element of a connecting line from the pump operating chamber to the low pressure chamber which is provided with a throttle point.

One such fuel injection pump is already known (DT-OS 1,576,466, FIG. 5), in which the necessary pressure drop in the pump operating chamber and in the injection line is delayed by a throttled preliminary shut-off shortly before the actual shut-off to terminate the injection, in order to avoid cavitation in the injection system and late injections by the fuel injection valves. The pump piston of this pump has two recesses which terminate in chamfered control edges, of which the first recess, which can be opened by its associated control bore shortly before the second, is itself formed as a throttle point and is machined into the outer surface of the piston as a flat control groove. Achieving a throttling that is the same in every load position is practically impossible with this type of groove, especially when there are several pump pistons in multiple cylinder pumps, because an absolutely equal depth and breadth of the groove along the entire control edge cannot be produced economically. In small pumps with their associated extremely flat grooves, there is an additional difficulty of production, namely the problem of the influence of piston play, because such play changes the effective cross-section of the groove and thus also changes the throttling effect of the flat groove. Also problematic is the flow-rate dependence of the throttle effect at the control bore, and furthermore it must be seen as a disadvantage that the flat groove simultaneously determines the beginning point for the preliminary shut-off (by means of its position) and the throttling itself (by means of its cross section).

In another exemplary embodiment of the described fuel injection pump (DT-OS 1,576,466, FIG. 1), both recesses are provided with first and second control edge, between which is located the recess which causes the throttled shut-off control. The machining of this type of recess presents the same difficulties as that of the previously mentioned flat grooves discussed earlier.

Another construction which deviates from known fuel injection pumps has a longitudinal bore formed as a throttle bore, which serves as the only connection between the pump operating chamber and the recesses that are provided with control edges. This longitudinal bore serves to damp the pressure waves inside the pump piston that are caused by the shut-off. With this throttle, which is to be construed as a throttle for the entire quantity of fuel shut-off, however, the necessary throttled preliminary shut-off cannot be obtained, because the bore cannot be made small enough.

In another exemplary embodiment of this pump the desired preliminary shut-off is obtained by the throttle bore in the wall of the pump cylinder adjacent to the two opposite control edges. Because of the notch effect of the small throttle bore, this construction leads to cracks in the cylinder wall and thus to failure of the pump.

OBJECT AND SUMMARY OF THE INVENTION

The fuel injection pump according to the invention in contrast to the foregoing devices has the advantage that the throttle point, which is formed as a throttle bore in the pump piston may be easily machined and still have narrow tolerances. The throttle bore, which is to be arranged within the associated recess, exercises no additional control functions, and its position can therefore be freely chosen in a manner favorable to manufacturing purposes. The locations and sizes of the associated control bores in the wall of the pump cylinder can be adapted to the suction and discharge characteristics, without being influenced by the throttle bore, and can therefore also be manufactured with a correspondingly large diameter. By means of the separate control and position of the throttle bore, which is controlled exclusively by the first control edge, the subsequent unthrottled discharge from the pump operating chamber, which is controlled by the second control edge, can be set in an optimal manner, just as the throttling. Furthermore, the danger of cracks appearing, as occurs with the known arrangement of a throttle bore in the pump cylinder, is avoided.

It will also be noted from a careful perusal of this specification that this invention reveals that by adapting the relative positions between associated control edges and control bores, the beginning and the duration of the throttle effect can be set independently of the position of the throttle bore, and by slightly varying the angles of inclination of both control edges, the throttle effect can be changed in dependence on load. For example, during the delivery of small injection quantities (small load or idling) the throttle effect can be accordingly reduced or even completely eliminated. By means of this throttling of the fuel return flow, which is easily adaptable to the requirements of the internal combustion engine, the discharge of the pressure line can also be controlled by a pressure valve which is formed without a discharge piston, and in connection with the characteristic of the differing angles of inclination of the two control edges, this discharge is also adaptable to the performance of the internal combustion engine, so that the disadvantages of the known constant volume discharge can be avoided.

The invention will be better understood as well as further objects and advantages thereof become more apparent from the ensuing detailed description of preferred embodiments taken in conjunction with the drawings.

DESCRIPTION OF THE PREFERRED EMBODIMENT

The exemplary embodiments described in the FIGS. 1 through 5 are shown as chamfer-edge-controlled, single cylinder fuel injection pumps, but the invention also encompasses, of course, multiple cylinder fuel injection pumps, usually called series injection pumps.

Figure 1:
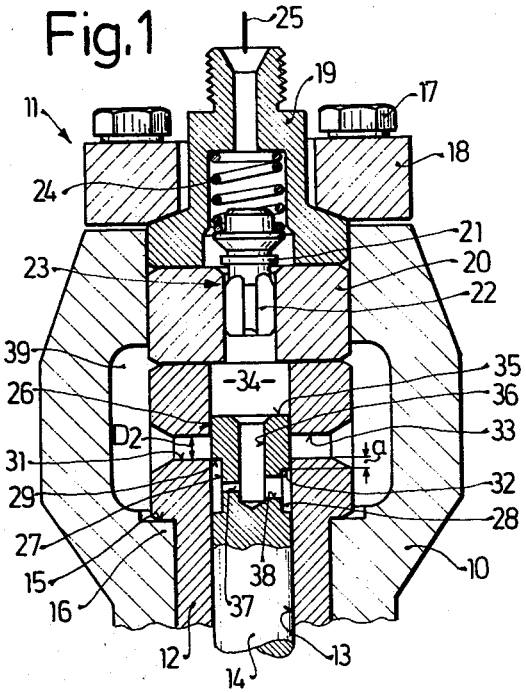
FIG. 1 is a fragmentary cross-sectional view of a first exemplary embodiment of the improved fuel pump.

Turning now to FIG. 1, and the first exemplary embodiment of the invention, there is shown a partial housing 10 of a fuel injection pump 11 which includes a pump cylinder 12 whose bore 13 guides a pump piston 14 which is arranged to move axially and rotationally. An annular shoulder 15 of the pump cylinder 12 is supported on a surface 16 within the housing 10 and is clamped against it by a clamping flange 18 with the use of screws 17, all of which is clear from the figure in the drawing. A tubular connector 19 and a valve 20 are interposed between the flange 18 and the upper portion of cylinder 12. The valve 20 comprises a movable valve member 22 with a suction ring 21 and constitutes an equal volume relief pressure valve 23.

The pump piston 14, which is driven in a known manner with a constant stroke by a cam shaft (not shown), has two diametrically opposite recesses 27 and 28 machined into its outer surface 26. The first recess 27 is provided with a control edge 29 which cooperates with a control bore 31 which is arranged in the wall of the cylindrical bore 13 and serves simultaneously as a suction and return flow bore. The second recess 28 forms a control edge 32 which cooperates with a second control bore 33 which lies diametrically opposite the first control bore 31 and has the same diameter.

Figure 2:
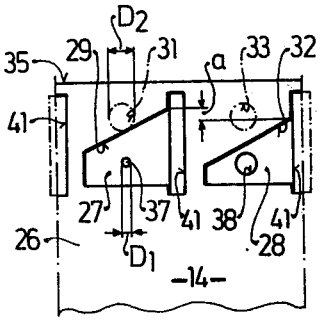
FIG. 2 is a schematic view of the outer surface of the pump piston, showing the positions of the control bores.

As may clearly be seen from the configuration of the outer surface 26 of the pump piston 14 shown in FIG. 2, the two recesses 27 and 28 are machined into the outer surface 26 so as to be separated from each other, and the two control edges 29 and 32, which in the present example run parallel to each other, are arranged next to the control bores 31 and 33, which lie opposite each other, and are displaced relative to one another in the axial direction of the pump piston 14 by a spacing distance a.

As seen in FIG. 1, during the delivery stroke of the pump piston 14, directed toward the pressure valve 23, first the control edge 29 opens the control bore 31, and only after a further partial stroke a does the control edge 32 then open a connection from the pump operating chamber 34 to the control bore 33. The pump operating chamber 34 is part of the cylindrical bore 13 and is defined on one side by a frontal surface 35 of the pump piston 14 and on the other side by the pressure valve 23. The outer surface 26 of the frontal surface 35 of the pump piston 14 forms a horizontal, so-called overhead control edge which achieves a constant delivery beginning. The pump piston 14 contains a blind longitudinal bore 36 that begins at its frontal surface 35. This bore 36 communicates with the recesses 27 and 28 by means of two cross bores 37 and 28. The cross bore 37, which connects the first recess 27 with the longitudinal bore 36 has a substantially smaller cross section than the cross bore 38, and thus serves as a throttle bore or throttle point in the connecting line between the pump operating chamber and a low pressure chamber 39. This low pressure chamber 39 is subject to the preliminary delivery pressure of the inflowing fuel and serves simultaneously as a suction and return flow chamber. The cross bore 38 is provided with approximately the same diameter as the longitudinal bore 36 or the control bore 33, and thus represents an unthrottled connection between the pump operating chamber 34 and the suction chamber 39. Both cross bores 37 and 38 are on the same axis and are machined into the pump piston 14 at right angles to the longitudinal axis of the piston. These measures simplify both the calibration of the throttle bore 37 and its burr removal.

Both recesses 27 and 28 have a stop groove 41 on the face closest to the frontal surface 35. These stop grooves 41 are produced with equal width and length to simplify production, and in contrast to known stop grooves, these penetrate into the pump piston 14, although not completely through to the frontal surface 35 of the piston, ending at such a distance from this frontal surface 35 that no pressure delivery is possible in the rotation position of the pump piston where the control bores 31 and 33 cooperate with these top grooves 41, because this distance is shorter than the diameter of the control bores 31 and 33 (see the control bores 31 and 33 illustrated by the broken lines in FIG. 2).

Figure 4:
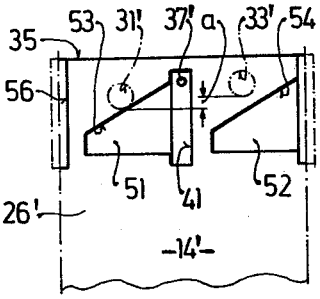
FIG. 4 is a schematic view of the positioning of the control bores of the embodiment of FIG. 3.
Figure 3:
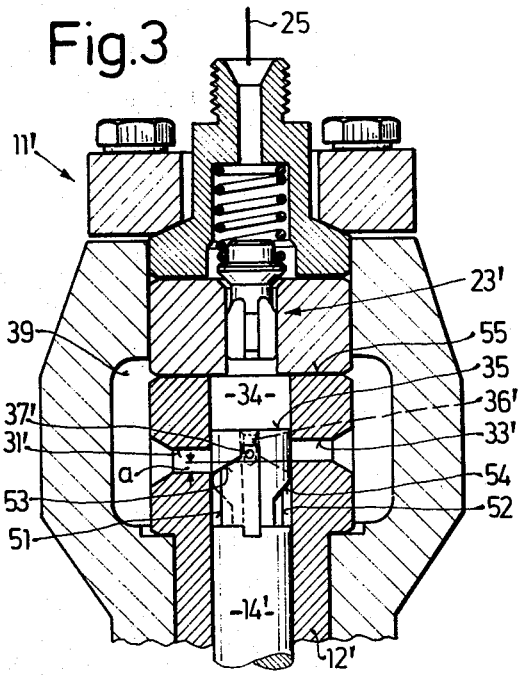
FIG. 3 is a further fragmentary cross-sectional view of the second exemplary embodiment of this invention.

The fuel injection pump 11′ illustrated in FIGS. 3 and 4 is primarily distinguished from the first exemplary embodiment shown in FIGS. 1 and 2 in that the pump piston 14′ has two recesses 51 and 52 in its outer surface 26′, whose first control edge 53 runs exactly parallel to the second control edge 54 formed on the second recess 52. Both control edges 53 and 54 also have an identical distance from the frontal surface 35 of the pump piston 14′. Instead of the control edges 29 and 32 of the first exemplary embodiment, which are displaced relative to each other by the spacing distance a, in the exemplary embodiment according to FIGS. 3 and 4, the two control bores 31′ and 33′ are displaced by the spacing distance a relative to each other, so that the edge of the control bore 31′ which determines the end of delivery and which cooperates with the first recess 51 is arranged farther away from the end 55 of the pump cylinder 12′ than the corresponding edge of the other control bore 33′ being displaced toward the pump operating chamber by the spacing distance a, which effectuates a throttled preliminary shut-off.

Like the recess 27 of the first exemplary embodiment, the first recess 51 of the second embodiment is connected with the pump operating chamber 34 by means of a throttle bore 37′ which opens into a longitudinal bore 36′ of the pump piston 14′. In order to keep the dead space associated with the pump operating chamber as small as possible, this throttle bore 37′ is bored as close as possible to the frontal surface 35 from the stop groove 41 into the longitudinal bore 36′. The longitudinal bore 36′ can be formed much smaller than the longitudinal bore 36 in FIG. 1, because it must only allow passage for a certain preliminary shut-off quantity determined by the throttle 37′. This is made possible by the fact that in place of the cross bore 38 shown in FIGS. 1 and 2, the second recess 52 has a stop groove 56 which penetrates through to the frontal surface 35, and which thus produces a direct unthrottled connection to the pump operating chamber 34.

Figure 5:
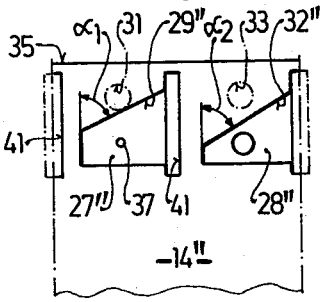
FIG. 5 is a schematic view according to FIG. 4, except that it is for the third exemplary embodiment.

The third exemplary embodiment which is illustrated only by the embodiment in FIG. 5, is distinguished from the first exemplary embodiment in FIGS. 1 and 2 in that the angles of inclination $\alpha_1$ and $\alpha_2$ of the control edges 29″ and 32″ are slightly dissimilar. The angle of inclination $\alpha_2$ of the control edge 32'' is somewhat smaller than the angle of inclination $\alpha_1$ of the control edge 29'' and the position of both control edges 29'' and 32'' of the recesses 27'' and 28'' of the pump piston 14'' are arranged in the embodiment shown in FIG. 5 in such a manner that they begin at about the same distance from the frontal surface 35 at the stop grooves 41 and then move away from each other in the direction where a larger delivery quantity is allowed. This results in both control edges being opened at almost the same time by the control bores 31 and 33 under smaller loads. But under larger loads the preliminary shut-off according to the invention, throttled by means of the throttle bore 31, takes place through the control bore 31 by means of the control edge 29''. This different angle of inclination of the two control edges can, of course, also be employed in principle with the second exemplary embodiment, in order to obtain a load-dependent preliminary shut-off there, too.

The method of operation of the preliminary shut-off, which can be achieved with the invention, is explained below with the aid of FIGS. 1 and 2.

In FIG. 1 the pump piston 14 is shown in the position it assumes shortly before the end of the pump delivery. The valve member 22 of the pressure valve 23 is open, thus not hindering the flow of fuel. As the pump piston 14 moves farther upward the control edge 29 of the recess 27 opens a connection which is throttled by a throttle bore 37. This connection leads from the pump operating chamber 34 through the longitudinal bore 36, the recess 27 in the pump piston 14 and the control bore 31 to the suction chamber 39. Thus there takes place a return flow of the fuel found in the pump operating chamber 34, which is damped by the throttle bore 37. The delivery also stops and the valve member 22 closes the connection to the pressure line 25 and thereby to the injection nozzle with the aid of the force of the spring 24 and the fuel in the pressure line 25. According to the invention this closing takes place in a damped manner caused by the throttle bore 37. After completion of the partial stroke determined by the spacing distance a, the second control edge 32 opens the associated control bore 33 and the further return flow of fuel takes place undamped into the suction chamber 39, because the cross bore 38 has approximately the same diameter as the longitudinal bore 36 and the control bore 33. This prevents the pressure valve 23 from being reopened, especially when the pump piston continues upward under a small load.

Favorable results are also obtained with a pump embodiment in which the diameter $D_1$ (see FIG. 2) of the throttle bore 37 is no more than one fourth of the diameter $D_2$ of the associated control bore 31. One experimental embodiment having a pump piston diameter of 15 millimeters had a spacing distance a of 2 millimeters, a diameter $D_1$ of 0.8 to 1.2 millimeters and a diameter $D_2$ of the control bore of 6 millimeters.

The second exemplary embodiment shown in FIGS. 3 and 4 has the same method of operation as the previously described first exemplary embodiment, except that the pressure valve (23' in these FIGS.) has no return suction collar and is therefore represented as a simple return flow valve. In this pump the discharge of the pressure line 25 is determined exclusively by the throttle bore 37' in the pump piston 14', and the discharge can be especially advantageously adapted to the requirements of the internal combustion engine when the two control edges 53 and 54 have different angles of inclination $\alpha_1$ or $\alpha_2$ (not shown) as in the third exemplary embodiment.

The foregoing relates to preferred embodiments of the invention, it being understood that other embodiments and variants thereof are possible within the spirit and scope of the invention, the latter being defined by the appended claims.

What is claimed and desired to be secured by letters patent of the United States is:

1. An oblique-edge-controlled fuel injection pump for internal combustion engines having an axially and rotationally movable pump piston guided in a pump cylinder, which pump piston includes two diametrically opposite recesses, delimited by oblique control edges, in its outer surface, which recesses are in continual communication with the pump operating chamber and can be connected with a low pressure chamber through two control bores lying opposite each other in the wall of the pump cylinder to terminate the effective fuel delivery stroke, and of which the first recess can be opened shortly before the second by its associated control bore and serves as an element of a connecting line from the pump operating chamber to the low pressure chamber which is provided with a throttle point, the improvement wherein said first recess is connected exclusively with a blind-bore type longitudinal bore through a cross bore, said longitudinal bore being arranged to extend from the pump operating chamber into said pump piston and that said cross bore is formed to provide a throttle bore whose diameter ($D_1$) is not more than one fourth of the diameter ($D_2$) of one of said control bores.

2. A fuel injection pump as claimed in claim 1, wherein said oblique control edges ($\alpha_1$, $\alpha_2$) are arranged at varying degrees of angulation (FIG. 5).

3. A fuel injection pump as claimed in claim 1, wherein at least one of said recesses is connected with said longitudinal bore through a second cross bore which is arranged in an extension of the throttle bore and produces an unthrottled connection to said pump operating chamber.

4. A fuel injection pump as claimed in claim 3, wherein said oblique control edges ($\alpha_1$, $\alpha_2$) are arranged at varying degrees of angulation (FIG. 5).

5. A fuel injection pump as claimed in claim 1, wherein said pump operating chamber is arranged to be closed by a pressure valve.

6. A fuel injection pump as claimed in claim 5, wherein said pressure valve is spring loaded and arranged to function as a return flow valve.

7. A fuel injection pump as claimed in claim 1, wherein said pump cylinder has a terminal end portion and further wherein the one of said control bores which cooperates with the first recess to control the end of fuel delivery is arranged farther away from said terminal end portion of said pump cylinder than said other control bore.

8. A fuel injection pump as claimed in claim 7, wherein said oblique control edges ($\alpha_1$, $\alpha_2$) are arranged at varying degrees of angulation (FIG. 5).

9. A fuel injection pump as claimed in claim 7, wherein said bores are spaced apart by a distance a to effect throttled preliminary shut-off of fuel flow.

10. A fuel injection pump as claimed in claim 9, wherein said pump operating chamber is arranged to be closed by a pressure valve.

* * * * *